US009835049B2

(12) United States Patent
Arnould

(10) Patent No.: US 9,835,049 B2
(45) Date of Patent: Dec. 5, 2017

(54) TURBOMACHINE DISTRIBUTOR COMPRISING A THERMAL PROTECTION SHEET WITH A RADIAL STOP, AND ASSOCIATED THERMAL PROTECTION SHEET

(71) Applicant: SNECMA, Paris (FR)

(72) Inventor: Julien Arnould, Maisons Alfort (FR)

(73) Assignee: SNECMA, Paris (FR)

( * ) Notice: Subject to any disclaimer, the term of this patent is extended or adjusted under 35 U.S.C. 154(b) by 278 days.

(21) Appl. No.: 14/427,723

(22) PCT Filed: Sep. 9, 2013

(86) PCT No.: PCT/FR2013/052068
§ 371 (c)(1),
(2) Date: Mar. 12, 2015

(87) PCT Pub. No.: WO2014/041290
PCT Pub. Date: Mar. 20, 2014

(65) Prior Publication Data

US 2015/0252687 A1 Sep. 10, 2015

(30) Foreign Application Priority Data

Sep. 12, 2012 (FR) ..... 12 58574

(51) Int. Cl.
*F01D 25/12* (2006.01)
*F01D 9/04* (2006.01)
(Continued)

(52) U.S. Cl.
CPC ..... *F01D 25/12* (2013.01); *F01D 1/02* (2013.01); *F01D 9/042* (2013.01); *F01D 11/08* (2013.01);
(Continued)

(58) Field of Classification Search
CPC ..... F01D 1/02; F01D 9/02; F01D 9/04; F01D 9/041; F01D 9/042; F01D 11/08; F01D 25/12; F01D 25/24; F01D 25/246
(Continued)

(56) References Cited

U.S. PATENT DOCUMENTS 5,188,507 A * 2/1993 Sweeney ..... B23H 9/10 415/170.1
5,201,846 A * 4/1993 Sweeney ..... F01D 9/04 415/170.1
(Continued)

FOREIGN PATENT DOCUMENTS

DE 101 22 464 C1 3/2002
DE 100 48 156 A1 4/2002
FR 2 960 591 A1 12/2011

OTHER PUBLICATIONS

International Search Report dated Dec. 6, 2013 in PCT/FR2013/052068 Filed Sep. 9, 2013.
(Continued)

*Primary Examiner* — Aaron R Eastman
(74) *Attorney, Agent, or Firm* — Oblon, McClelland, Maier & Neustadt, L.L.P.

(57) ABSTRACT

A distributor of a turbomachine configured to be mounted in a housing, including: a plurality of segments; a plurality of anti-rotation pins, mounted both on a segment of the distributor and on the housing; and a thermal protection sheet, including at least one axial tab configured to radially abut against an inner face of a first anti-rotation pin, and at least one radial tab configured to axially abut against an upstream face of a second anti-rotation pin.

5 Claims, 4 Drawing Sheets

(51) Int. Cl.
*F01D 11/08* (2006.01)
*F01D 25/24* (2006.01)
*F01D 1/02* (2006.01)

(52) U.S. Cl.
CPC ..... *F01D 25/246* (2013.01); *F05D 2230/64* (2013.01); *F05D 2260/231* (2013.01)

(58) Field of Classification Search
USPC ..... 415/178, 218.1
See application file for complete search history.

(56) References Cited

U.S. PATENT DOCUMENTS 5,411,369 A * 5/1995 Bouchard ..... F01D 25/246 415/189
5,775,874 A * 7/1998 Boite ..... F01D 25/246 415/209.1
2004/0213666 A1 10/2004 Gieg et al.
2006/0216143 A1* 9/2006 Trinks ..... F01D 9/04 415/173.1
2012/0027598 A1* 2/2012 Caprario ..... F01D 5/082 416/193 R
2012/0128481 A1* 5/2012 Baumas ..... F01D 9/042 415/209.2
2013/0078086 A1* 3/2013 Breugnot ..... F01D 25/246 415/182.1
2014/0219791 A1* 8/2014 Richardson ..... F01D 25/246 415/209.2

OTHER PUBLICATIONS

French Search Report dated Jun. 3, 2013 in Patent Application No. FR1258574 (with English Translation of Category of Cited Documents).
International Search Report dated Dec. 6, 2013 in PCT/FR2013/052068 (with English Translation of Category of Cited Documents).

* cited by examiner

TURBOMACHINE DISTRIBUTOR COMPRISING A THERMAL PROTECTION SHEET WITH A RADIAL STOP, AND ASSOCIATED THERMAL PROTECTION SHEET

The invention generally relates to the field of turbomachines, and more particularly to thermal protection elements designed to be mounted in a distributor, for example a turbine annular distributor on a turbine housing.

Figure 5:
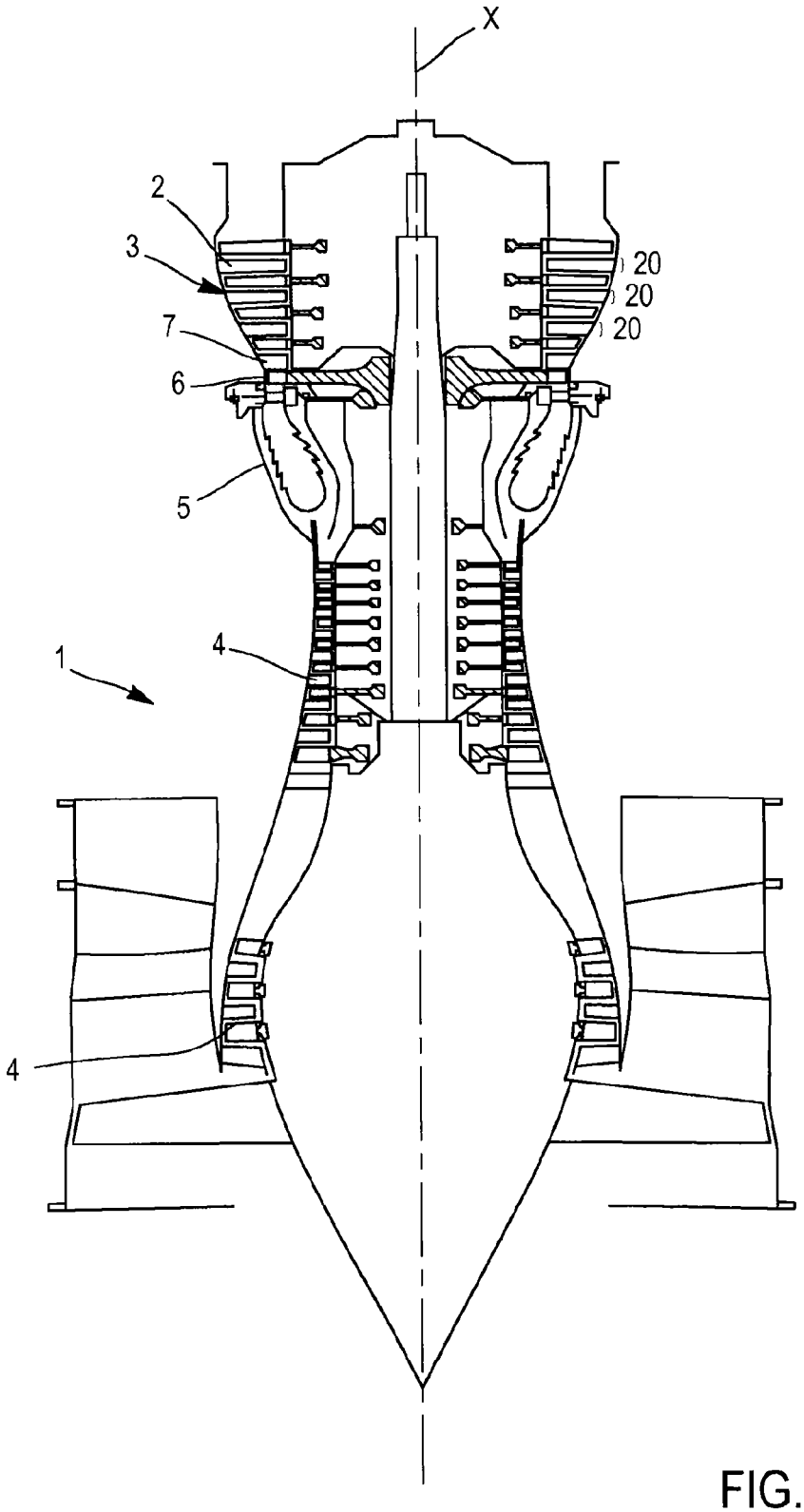

A turbomachine example has been illustrated in FIG. 5.

A turbomachine typically includes a nacelle which forms an opening for admitting a determined air flow to the engine strictly speaking. Generally, the turbomachine comprises one or several sections 4 for compressing the air admitted into the engine (generally a low pressure section and a high pressure section) and a combustion chamber 5, in which the thereby compressed air is mixed with fuel before being burnt therein.

The hot combustion gases from this combustion are expanded in the various turbine stages, generally including a high pressure stage 6 immediately downstream from the chamber 5 and which receives the gases with the highest temperature. After this first expansion, the gases are again expanded by being guided through the so-called low pressure stages 7.

A low pressure turbine 7 conventionally includes one or several rows of turbine blades spaced out circumferentially all around the rotor of the turbine 7. It also comprises a low pressure distributor 2 giving the possibility of directing the flow of gases from the combustion chamber 5 towards the turbine blades at a suitable angle and velocity in order to drive into rotation the blades and the rotor of the turbine 7.

The distributor 2 comprises a plurality of blades positioned radially with respect to an axis of rotation of the turbomachine X connecting a radially internal annular element and a radially external annular element. The whole forms an annular vein facing the movable blades of the turbine.

More specifically, the low pressure distributor 3 is formed with fixed blades positioned in a wheel divided into a plurality of segments, circumferentially distributed around the axis X of the turbomachine. Each segment comprises several fixed adjacent blades secured to one element in a ring sector, as well as an upstream retention means and a downstream retention means. Here, upstream and downstream are defined by the direction of flow of the gases in the turbomachine. These retention means are for example annular rails made in the internal wall of the housing upon which will bear a supporting surface made on the ring sectors of the distributor segments. The assembly is laid out so as to allow relative expansion of the distributor with respect to the housing, depending on the speed variations of the engine. However, due to the axial symmetry of the distributor wheels and of the tangential forces resulting from the gas flow crossing them, provision has to be made for means blocking the rotating sectors.

For this, patent FR 2 743 603 in the name of the Applicant describes a method for mounting such distributor segments inside a housing. The segments of distributors comprise a peripheral outer rib, perpendicular to the axis of the distributor (and therefore of the turbomachine), bearing through upstream and downstream faces upon corresponding faces of the internal wall of the housing. A protrusion on the upstream face of the rib of each segment comprises a notch in which is accommodated an anti-rotation pin. This pin comprises a head accommodated in the notch and a rod slipped into a radial bore of the wall of the housing, and thereby prevents any rotary movement of the distributor segment around its axis.

In order to protect the wall of the housing against heat radiation from the distributor, notably from the low pressure distributor, a metal sheet is generally interposed between the distributor and the internal wall of the housing. This thermal protection metal sheet upstream bears against a radial surface portion made in the internal wall of the housing. The upstream edge of the protection sheet is radially curved inwards so as to form a hairpin which also bears upon an upstream edge of the distributor and participates in maintaining the latter against the upstream rail of the housing. Downstream, the protection sheet comprises an indentation with a tab in the bottom of the indentation.

This assembly gives entire satisfaction as regards maintaining the distributor inside the housing and thermal protection of the latter.

It was however ascertained that the metal sheet was able to disengage from its contact with the anti-rotation pin. As it is no longer retained, the tab risks rubbing against the internal face of the wall of the housing and causing <<fretting>> phenomena of the latter (wear of the wall).

It was therefore proposed to form, at the downstream end of the protection sheet, a radially curved edge inwards so as to form a hairpin in a similar way to its upstream end. This hairpin-shaped downstream edge then allows a surface-surface contact to be generated at the interface between the thermal protection metal sheet and the housing. However, this solution today seems difficult to produce, insofar that it requires implementation of a permanent ring on the metal sheet in order be able to form the hairpin-shaped downstream edge, this portion of the metal sheet cannot be removed from the mold. This solution is therefore expensive from the point of view of the final mass of the assembly just as from the point of view of its making.

Document FR 2 960 591, also in the name of the Applicant, and which is illustrated with reference to FIG. 1, proposes, as for it, a modification of the anti-rotation pin 40 so that it is used as an abutment for the tab in a possible radial displacement of the metal sheet during the operation of the turbomachine. Indeed, by interposing a stop between the portion of the metal sheet 10 which may move during operation, the risks of contact with the internal wall 30 of the housing are eliminated. For this, a shoulder 40*a* is formed on the anti-rotation pin 40, a radially extending from the pin 40 between the tab 12*a* and the internal wall of the housing 30.

Making this shoulder 40*a* however increases the overall cost for making the anti-rotation pin 40, as well as its bulkiness. Document DE 100 48 156 describes a thermal protection metal sheet for a distributor, the downstream end of which is curved, adapted for coming into contact against a ring segment.

Finally, document DE 101 22 464 proposes a distributor comprising a thermal protection metal sheet, provided with elements forming a stop, adapted for bearing against the housing and preventing rotation of the distributor. Nevertheless, during expansions of the distributor, the elements forming a stop risk rubbing against the internal face of the housing and of wearing it out prematurely.

An object of the invention is therefore to propose means for blocking in rotation a segment of a distributor, notably a low pressure distributor of a turbomachine, with respect to a turbine housing of the turbomachine, which are further capable of protecting the housing from heat radiation from the distributor and of avoiding the risks of premature wear of the housing due to friction processes, and which are further of a moderate cost and easy to make.

For this purpose, the invention proposes a distributor for a turbomachine, notably a low pressure distributor, suitable for being mounted in a housing, comprising:

a plurality of circumferentially distributed segments around an axis of rotation of the turbomachine, a plurality of anti-rotation pins, mounted both on a segment of the distributor and on the housing, and a thermal protection metal sheet, positioned between the housing and the segments of the distributor, comprising a plurality of tabs, each being adapted to bear against an anti-rotation pin.

The thermal protection metal sheet comprises at least one axial tab adapted to radially abut against a lower face of a first anti-rotation pin, and at least one radial tab adapted to axially abut against an upstream face of a second anti-rotation pin.

Certain preferred but non-limiting features of the distributor according to the invention are the following:

the thermal protection metal sheet comprises a plurality of axial tabs and of radial tabs, the thermal protection metal sheet substantially comprises as many radial tabs as there are axial tabs, the radial tabs and the axial tabs alternate along the thermal protection metal sheet, around the axis of rotation of the turbomachine, and are separated by an indentation, preferably with material removal, a circumferential width of said at least one axial tab corresponding to the distance separating three adjacent anti-rotation pins, and said at least one axial tab is at a distance from the anti-rotation pin when the turbomachine is at rest.

The invention also proposes a protective thermal protection metal sheet able to be used in a distributor as described above, comprising at least one so-called radial tab, adapted to axially abut against an upstream face of a first anti-rotation pin, and at least one so-called axial tab, adapted to radially abut against aid lower face of a second anti-rotation pin.

Certain preferred but non-limiting features of a thermal protection metal sheet according to the invention are the following:

it comprises a plurality of radial tabs and of axial tabs which alternate along said thermal protection metal sheet, and the tabs are in one piece with said thermal protection metal sheet.

Finally, the invention proposes a turbomachine comprising a distributor as described above.

Figure 1:
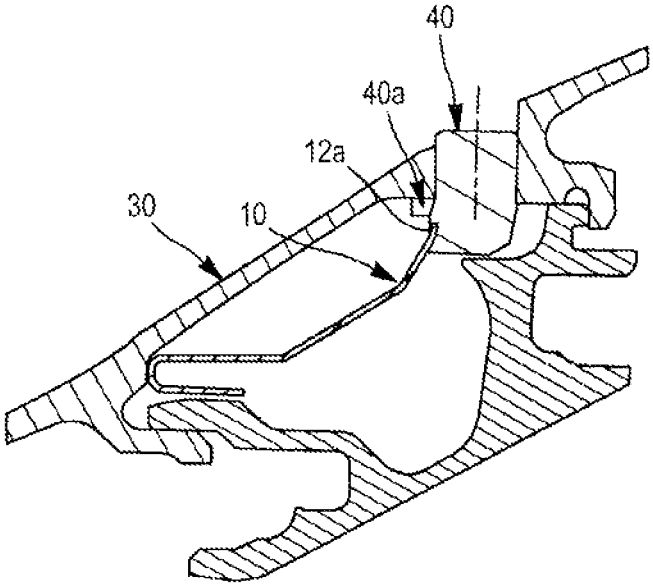
FIG. 1 (BACKGROUND ART)
Figure 2:
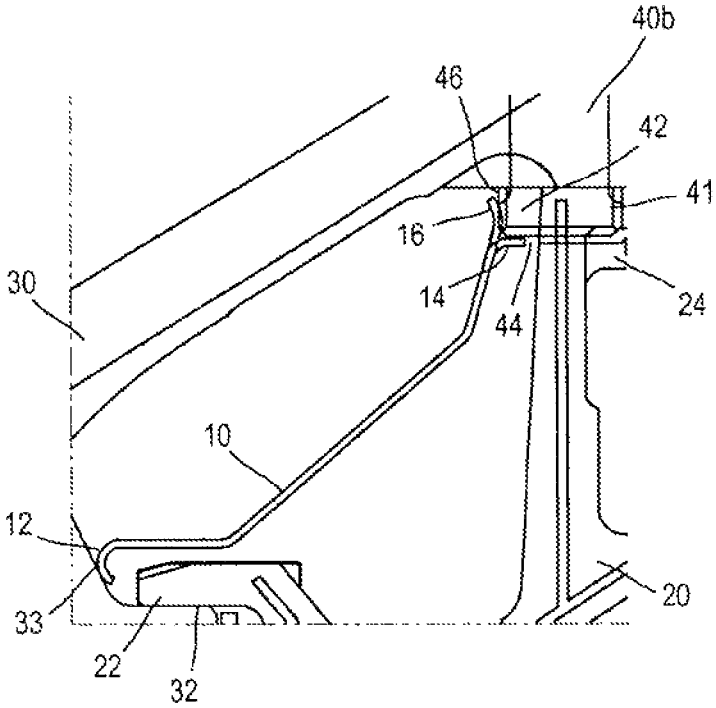
Figure 3A:
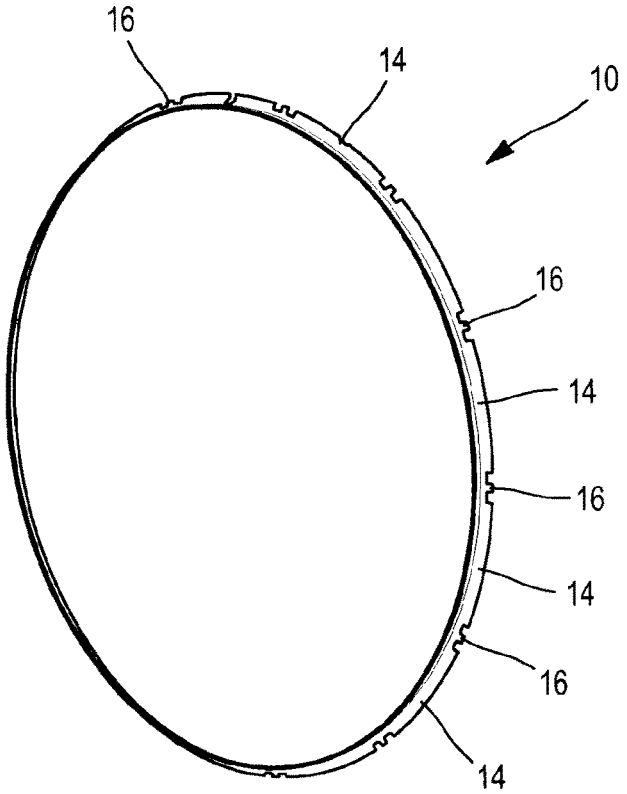
Figure 3B:
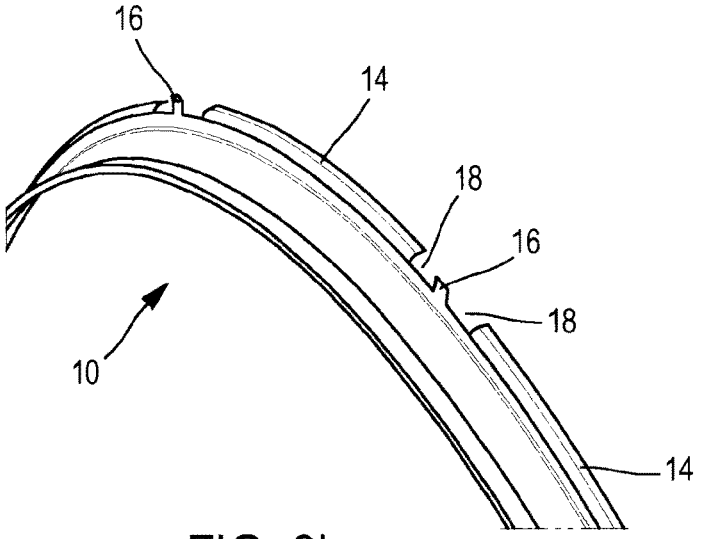
Figure 4A:
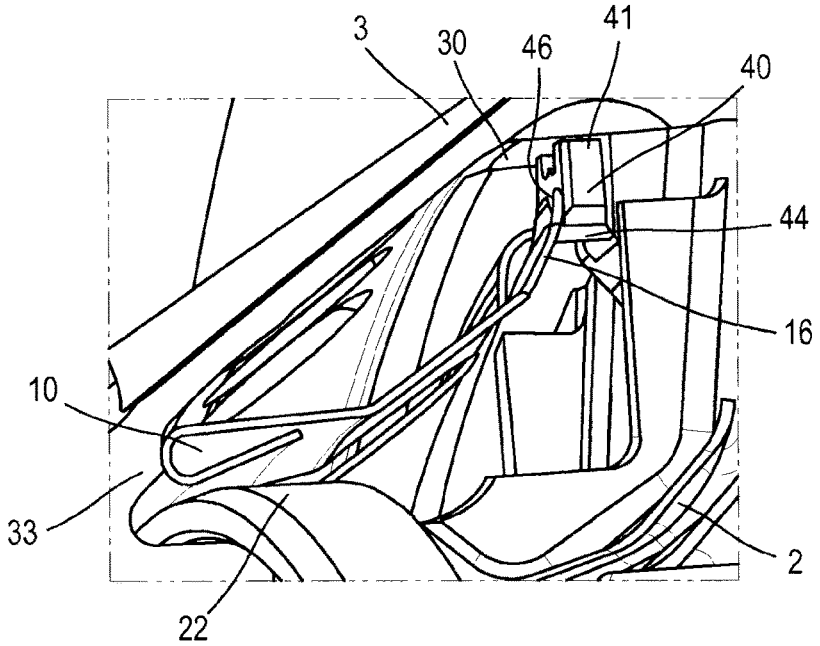
Figure 4B:
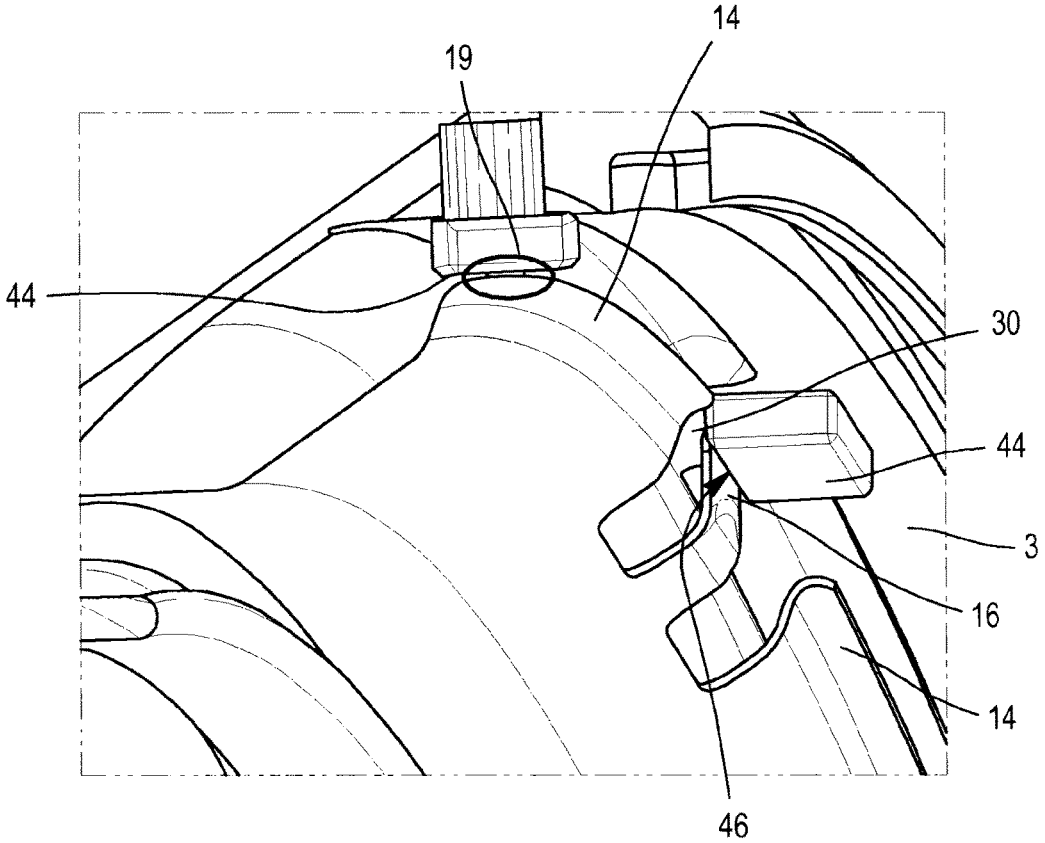

Other features, objects and advantages of the present invention will become better apparent upon reading the detailed description which follows, made with reference to the appended figures given as non-limiting figures and wherein:

FIG. 1 is a partial axial sectional view of a turbine distributor mounted in a housing of a turbomachine according to the prior art, FIG. 2 is a partial axial sectional view of an exemplary turbine distributor mounted in a housing of a turbomachine according to the invention, FIG. 3*a* is a perspective view of an exemplary thermal protection metal sheet according to the invention, FIG. 3*b* is a detailed view of a portion of the thermal protection metal sheet of FIG. 3*a*, FIG. 4*a* is a first perspective view of the example of FIG. 2, FIG. 4*b* is a second perspective view of the example of FIG. 2, and FIG. 5 illustrates an exemplary turbomachine onto which the invention is applied.

The invention will now be most particularly described with reference to a low pressure distributor 2 of a turbomachine 1, mounted on a housing 3 of a low-pressure turbine 7.

A low pressure distributor 2 is formed that with fixed blades positioned on a wheel divided into a plurality of segments 20, circumferentially distributed around an axis of rotation X of the turbomachine 1. Each segment 20 comprises several fixed adjacent blades secured to a ring sector element, as well as an upstream retention means and a downstream retention means. These retention means are for example annular rails 32, 24 made in an internal wall 30 of the housing 3 upon which supporting surfaces 22, 24 will bear, made on the ring sectors of the segments 20 of a distributor 2 as described above.

In order to block the sectors in rotation, the distributor 2 comprises a plurality of devices for blocking the segments, each comprising an anti-rotation pin 40, mounted both on a segment 20 of the distributor 2 and on the turbine housing 3. Similarly to what is described in document FR 2 960 951, a protrusion on the upstream face of each segment 20 comprises an indentation in which is accommodated the anti-rotation pin 40. This pin 40 comprises a head 41 accommodated in the indentation and a rod 42 slipped into a radial bore of the wall 30 of the housing 3, and thereby prevents any movement of rotation of the distributor segment 20 around the axis of the latter (corresponding to the axis of rotation X of the turbomachine).

A thermal protection metal sheet 10 is interposed between the segments 20 of the low pressure distributor 2 and the internal wall 30 of the turbine housing 3, and adapted for limiting the heat radiation from the distributor 2 on the turbine housing 3. This thermal protection metal sheet 10, upstream, bears against a radial surface portion 33 made in the internal wall of the housing. Conventionally, the upstream edge 12 of the protection sheet 10 is radially curved inwards so as to form a hairpin. Optionally, the upstream edge may further bear upon an upstream edge of the segment 20 of the distributor 2 and participate in maintaining the latter against the upstream rail 32 of the housing 3.

Downstream, the thermal protection metal sheet 10 comprises a plurality of tabs 14, 16, each being adapted to bear against an anti-rotation pin 40 of the blocking devices.

In order to limit the risks of "fretting" generated by the contact between the thermal protection metal sheet 10 and the housing 3, the metal sheet 10 is modified at its downstream portion. Indeed, the thermal protection metal sheet 10 comprises tabs 14, 16 adapted so that the metal sheet radially abuts and axially abuts against the anti-rotation pins 40. The thermal protection metal sheet is therefore maintained in position against the anti-rotation pins 40, while is displacement is limited in the direction of the internal wall 30 of the housing 3. Here, by radial direction will be meant a direction extending substantially transversely with respect to the axis X of the turbomachine, and by axial direction will be meant a direction extending substantially parallel to the axis X of the turbomachine.

For example, the tabs 14, 16 of the thermal protection 10 may comprise axial tabs 14, adapted to radially abut against the corresponding anti-rotation pin 40, and radial tabs 16, adapted to axially abut against the corresponding anti-rotation pin 40.

Thus, the radial tabs 16 extends transversely with respect to the axis X of the turbomachine 1, and give the possibility of maintaining in an axial position the thermal protection metal sheet 10 with respect to the distributor 2. These radial tabs 16 therefore form axial stops. For this, the radial tabs 16 are for example laid out to extend facing an upstream face 46 of the anti-rotation pins 40, this upstream face 46 corresponding to the face of the anti-rotation pins directed towards the upstream side of the turbomachine 1, facing the gas flow.

The axial tabs 14, as for them, substantially extend parallel to the axis X of the turbomachine 1, and give the possibility of preventing the thermal protection metal sheet 10 from moving towards the turbine housing 3, i.e. along a radial direction. This is why these axial tabs form radial stops. The axial tabs 14 are for example laid out to extend facing a lower face 44 of the anti-rotation pins 40, this lower face 44 corresponding to the face of the anti-rotation pins 40 directed towards the axis of rotation X of the turbomachine 1, facing the distributor 2.

According to an embodiment, the thermal protection metal sheet 10 substantially comprises as many axial tabs 14 as there are radial tabs 16. Thus, if the distributor 2 comprises twenty-six anti-rotation pins 40, the thermal protection metal sheet 10 may for example comprise thirteen axial tabs 14 and thirteen radial tabs 16.

The radial tabs 16 and the axial tabs 14 may moreover be distributed in alternation along the periphery of the thermal protection metal sheet 10, in order to observe the symmetry of the turbomachine 1 and to balance the distributor 2.

The thermal protection metal sheet 10 is preferably ring-shaped, and may be in one piece, i.e. in a single part, or obtained by association of several annular segments connected together.

The tabs 14, 16 may be formed integrally with the remainder of the thermal protection metal sheet 10. For example they may be obtained by cutting the downstream edge of the thermal protection metal sheet 10 to form indentations 18, with or without removal of material. In the embodiment illustrated in FIGS. 1 to 4*b*, the indentations 18 are made with removal of material, in order to avoid possible friction of the axial tabs 14 against the anti-rotation pin 40 upon thermal expansion of the distributor 2.

Further, the thermal protection metal sheet 10 may comprise one tab 14, 16 per anti-rotation pin 40, so that for a given anti-rotation pin 40, the thermal protection metal sheet 10 has opposite either a radial tab 16, or an axial tab 14. Alternatively, the thermal protection metal sheet 10 may comprise one radial tab 16 and one axial tab 14 per anti-rotation pin 40. A same anti-rotation pin 40 may then be found in radially abutting against an axial tab 14 and axially abutting against a radial tab 16.

The axial tabs 14 may be wider (along the circumference of the thermal protection metal sheet 10) than the radial tabs 16. For example, a circumferential width of an axial tab 14 may correspond to the distance separating three adjacent anti-rotation pins 40. A given axial tab 14 may therefore not only extend facing the corresponding anti-rotation pin 40, but also on either side of this pin 40 as far as the adjacent anti-rotation pins 40, the adjacent anti-rotation pins 40 each being found facing another tab preferably a radial tab 16. This embodiment actually gives the possibility of simplifying the making of the thermal protection metal sheet 10, of reinforcing the resistance to radial forces of the axial tab 14 applied by the anti-rotation pin 40, and of avoiding contact of the metal sheet 10 with the turbine housing 3 in spite of the vibrations to which the latter is subject, and also gives the possibility of obtaining better protection against heat radiation.

The radial tabs 16, as for them, then have a width (along the circumference of the thermal protection metal sheet 10) substantially corresponding to the width of the upstream face 46 facing the anti-rotation pin 40.

Alternatively, the radial tabs 16 are the ones which are wider than these axial tabs 14, and they extend between three adjacent anti-rotation pins 40, the axial tabs 14 then being of a width substantially equal to the width of the lower face 44 facing the anti-rotation pin 40.

According to another further alternative, the axial tabs 14 and the radial tabs 16 are of equal width and extend on either side of each anti-rotation pin 40, over a width globally equal to the distance between two adjacent anti-rotation pins 40.

Optionally, the radial tabs 16 may be introduced into a groove made in the face facing the corresponding anti-rotation pin 40.

Moreover, in the rest position, i.e. when the turbomachine 1 is not operating, the axial tabs 14 may extend facing the lower face 44 of the corresponding anti-rotation pins 40 and at a distance therefrom in order to allow a determined radial displacement of the thermal protection metal sheet 10 in the event of thermal expansion of the latter. This radial displacement is however limited, the axial tab 14 forming a radial stop when it comes into contact with the lower face 44 of the anti-rotation pin. Therefore there exists a space 19 between the axial tabs 14 and the lower surface 44 of anti-rotation pins 40, when the distributor 2 is at rest.

On the other hand, the radial tabs 16 are in contact with the upstream face 46 of the anti-rotation pins 40, regardless of whether the turbomachine 1 is at rest or operating, in order to maintain the thermal protection metal sheet 10 in position with respect to the distributor 2 and to the turbine housing 3.

The invention claimed is:

1. A distributor for a turbomachine, or a low-pressure distributor, to be mounted in a housing, comprising:

a plurality of segments circumferentially distributed around an axis of rotation of the turbomachine;

a plurality of anti-rotation pins, each of which is mounted both on a segment of the distributor and on the housing; and a thermal protection metal sheet, positioned between the housing and the segments of the distributor, comprising a plurality of tabs, each tab bearing against an anti-rotation pin;

wherein the plurality of tabs of the thermal protection metal sheet comprises at least one axial tab radially abutting against a radially inward face of a first anti-rotation pin, and at least one radial tab axially abutting against an upstream face of a second anti-rotation pin.

2. The distributor according to claim 1, wherein the thermal protection metal sheet comprises a plurality of the axial tabs and the radial tabs.

3. The distributor according to claim 1, wherein the number of the radial tabs and the number of the axial tabs is equal.

4. The distributor according to claim 1, wherein the radial tabs and the axial tabs alternate along the thermal protection metal sheet, around the axis of rotation of the turbomachine, and are separated by an indentation, or with removal of material.

5. The distributor according to claim 1, wherein the at least one axial tab is at a distance from the first anti-rotation pin when the turbomachine is at rest.

* * * * *